United States Patent [19]

Merics

[11] 4,367,663

[45] Jan. 11, 1983

[54] VARIABLE LENGTH TORQUE ROD

[76] Inventor: Joseph S. Merics, 1537 Carol, Burlingame, Calif. 94010

[21] Appl. No.: 249,084

[22] Filed: Mar. 30, 1981

[51] Int. Cl.[3] ..... B25G 1/04; B25G 3/00

[52] U.S. Cl. ..... 81/177 A; 403/377

[58] Field of Search ..... 81/177 R, 177 A, 177 G; 403/324, 326, 377, 378, 379

[56] References Cited

U.S. PATENT DOCUMENTS

| | | | |
|---|---|---|---|
| 2,869,410 | 1/1959 | Prichard | 81/177 A |
| 2,963,930 | 12/1960 | Clothier et al. | 81/177 A |
| 2,987,334 | 6/1961 | Wendling | 81/177 G X |
| 3,306,639 | 2/1967 | Lyon | 81/177 A X |
| 3,469,823 | 9/1969 | Blum et al. | 403/377 X |
| 3,924,493 | 12/1975 | Penner | 81/177 G |
| 4,317,393 | 3/1982 | Graffam | 81/177 A |

*Primary Examiner*—James G. Smith

*Attorney, Agent, or Firm*—Julian Caplan

[57] ABSTRACT

A torque rod of variable length permits use of a torque wrench in confined quarters since the distance between the wrench and unit being tightened may be readily adjusted. A sleeve with a non-circular hollow receives a hollow stem carrying a ball detent which fits into any of a series of depressions in the sleeve wall. Within the stem is a pin with a bevel on its inner end. By moving the stem, the bevel forces the ball in or out to permit the stem to be moved in or out relative to the sleeve. A cam determines motion of the pin.

7 Claims, 4 Drawing Figures

VARIABLE LENGTH TORQUE ROD

This invention relates to a new and improved variable length torque rod typically used to interconnect a wrench to an adapter which fits onto a nut or a screw to be tightened.

The invention is particularly useful in confined quarters, such as during repair of an engine. The length of the torque rod is adjustable; hence, the wrench may be spaced from the nut or screw a distance such that the wrench may be turned without contacting portions of the engine or other obstruction.

A particular feature of the invention is the fact that, if necessary, the rod may be adjusted in length using only one hand.

The purpose of the present invention is to transmit torque from a handle, such as a ratchet wrench or a power tool, to an adapter on the opposite end of the tool which engages a bolt or screw, and to vary the length of the device so as to accommodate different distances required by the particular exigencies of the job. Adjustment of length is extremely simple. The length is held against unintentional change by locking means.

The present invention eliminates the necessity of using a tool kit containing rods of different fixed lengths.

Other objects of the present invention will become apparent upon reading the following specification and referring to the accompanying drawings in which similar characters of reference represent corresponding parts in each of the several views.

Figure 1:
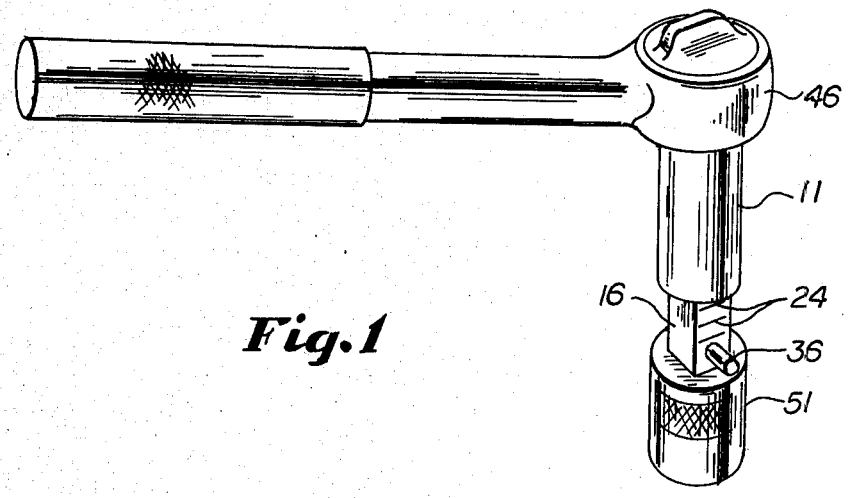
FIG. 1 is a perspective view showing use of the invention in a typical installation.

The tool of the present invention comprises a sleeve 11 of any external shape having a non-circular hollow 12, here shown to be square. In a straight longitudinally extending line on the inside of sleeve 11 at preferably equally spaced intervals, is a series of semi-spherical depressions 13. At a different location from the depressions 13, is a depression 14 adjacent the upper end of sleeve 11.

Fitting within the hollow 12 preferably with a sliding fit is a hollow stem 16, here also shown to be square in internal and external cross-section. The upper end 17 is closed. Slidable within the hollow in the stem 16 is actuating pin 18. Spring 19 between the end 17 and the pin 18 biases pin 18 to the left as viewed in FIG. 2. An opening 21 is formed in stem 16 to receive a ball 22 which may be caused to fit into any of the depressions 13. Bevel 26 in contact with ball 22 is formed on the inner end of pin 18 and the opposite or outer thereof is formed with a rounded end 27. Plug 28 closes off the outer end of the stem 16. Ball 29 is biased by spring 21 outwardly through hole 33 near the outer end of stem 16. Inward of hole 33 is a hole 32. There are preferably markings 24 on the exterior of stem 16 to indicate the combined lengths of sleeve 11 and stem 16.

Figure 2:
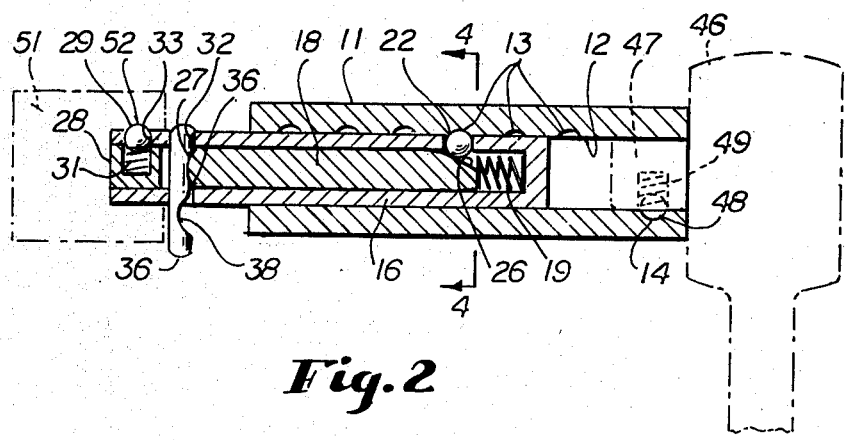
FIG. 2 is a sectional view through the tool showing the tool in one position of adjustment.
Figure 4:
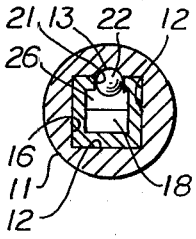
FIG. 4 is a fragmentary sectional view taken substantially along the line 4—4 of FIG. 2.
Figure 3:
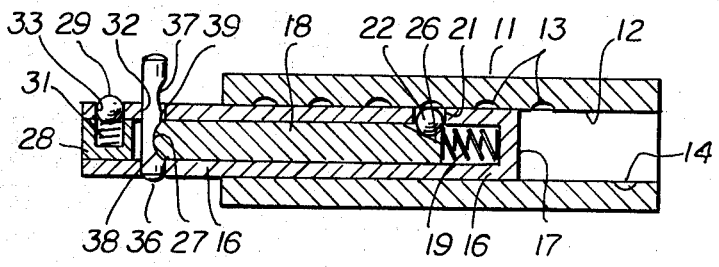
FIG. 3 is similar to FIG. 2 showing the tool in another position of adjustment.

Slidable transversely of the longitudinal axis of the tool in hole 32 is cam pin 36, which is longer than the width of stem 16. On the left hand end of pin 36, as viewed in FIG. 2 are two cam steps, namely, a high cam step 37 and deeper low cam step 38. Interconnecting the steps is a ramp 39. The steps 37 and 38 are concave and of a radius such as to accommodate the rounded end 27 of actuating pin 18. When the cam pin 36 is in the position shown in FIG. 2, end 27 is in the high step 37, forcing the pin 18 to the right so that the bevel 26 pushes ball 13 outwardly relative to opening 21 and into one of the depressions 13. When the pin 36 is moved to the position of FIG. 3, the rounded end 28 seats in the low step 38 and spring 19 forces the pin 18 to the left (relative to its position in FIG. 2) so that the ball 52 may drop out of the depression 13. This permits free sliding of the stem 16 relative to the sleeve 11 so that the overall length of the tool may be adjusted to the desired degree.

Directing attention now to FIG. 1, a typical use of the device is illustrated. Wrench 46 is shown to be of the ratchet type. It will be understood that a power tool might be substituted for the ratchet 46, or an ordinary wrench used. The wrench 46 has a projection 47 with a recess therein in which is a ball 48 biased outwardly by a spring 49. The projection 47 is inserted in the opening of the sleeve 11 so that the ball 48 fits into the depression 14 and detachably secures the wrench 46 to the sleeve 11. On the opposite end of the tool is an adapter 51 which preferably fits over a nut or screw (not shown). The adapter 51 has a recess 53 in its upper end to receive stem 16 and the recess 53 has a depression 52 to receive ball 29 therein.

With the parts assembled as in FIG. 1, the mechanic determines the over-all length between the wrench 46 and the adapter 51 which is necessary. Cam pin 36 is then moved to the position of FIG. 3 and the stem 16 extended or retracted to the required length, the markings 24 being useful for such determination. Thereupon the cam pin is moved to the position of FIG. 2 and the bevel 20 forces the ball 22 into the appropriate depression 13. This prevents relative movement of sleeve 11 and stem 16 when torque is applied and locks the length of the tool. Projection 47 is fitted into the upper end of sleeve 16 and the outer end of stem 16 is fitted into adapter 51.

What is claimed is:

1. An adjustable length connection for use between a driver member and driven member comprising a hollow sleeve having a non-circular interior and an open second end, the interior of said sleeve being formed with a series of longitudinally spaced depressions, a hollow stem shaped to fit inside said sleeve with a sliding fit and having a closed first end inside said sleeve, a second end external to said sleeve shaped to receive the other of said members, and a first hole formed in the wall of said shank transverse to the axis of said stem spaced from said first end, and an aligned pair of second holes transverse to said axis external to said sleeve, an actuating pin slidable in said stem having a first end formed with a cam surface and a second end formed with a cam follower surface, a detent movable in said first hole, said actuating pin when retracted in said stem forcing said detent outward of said stem and into a selected one of said depressions, a cam pin slidable in said second holes formed with first and second cams engaged by said cam follower surface, said cams controlling the position of said actuating pin relative to said stem between retracted and projected positions.

2. A connector according to claim 1 which further comprises a spring in said stem between said inner end and the inner end of said actuating pin biasing said actuating pin toward projected position.

3. A connector according to claim 1 in which said cam surface is a bevel formed on said first end.

4. A connector according to claim 3 in which said detent is a ball dimensioned to seat in said depression.

5. A connector according to claim 1 in which cam follower surface is rounded and said first and second cams are complementary to said cam follower surface and of different depths.

6. A connector according to claim 1 in which said second end of said stem is formed with a plug, and a detent means in said plug to detachably engage said other of said members.

7. A connector according to claim 1 in which the interior of said sleeve adjacent said first end is formed with a second depression to receive detent means of said first-mentioned member.

* * * * *